United States Patent [19]

Schade, Jr.

[11] 4,012,684

[45] Mar. 15, 1977

[54] VOLTAGE REGULATOR CIRCUIT WITH FET AND BIPOLAR TRANSISTORS

[75] Inventor: Otto Heinrich Schade, Jr., North Caldwell, N.J.

[73] Assignee: RCA Corporation, New York, N.Y.

[22] Filed: Mar. 29, 1976

[21] Appl. No.: 671,557

[52] U.S. Cl. ..... 323/8; 323/16; 323/22 T; 307/297

[51] Int. Cl.[2] ..... G05F 1/00

[58] Field of Search ..... 323/8, 16, 22 R, 22 T; 307/296, 297, 304

[56] References Cited

UNITED STATES PATENTS

| | | | |
|---|---|---|---|
| 3,244,949 | 4/1966 | Hilbiber | 323/8 |
| 3,875,430 | 4/1975 | Prak | 307/304 |
| 3,899,693 | 8/1975 | Gaudreault | 307/297 |

FOREIGN PATENTS OR APPLICATIONS

| | | | |
|---|---|---|---|
| 1,832 | 6/1971 | Japan | 323/16 |

OTHER PUBLICATIONS

*Electronics World*, Oct. 1967, pp. 30, 31 & 78, "Using The New Constant-Current Diodes" by D. E. Lancaster.

*IBM Tech. Disc. Bulletin*, vol. 14, No. 1, June 1971, p. 240, "FET Input CK7" by T. L. Palfi.

*IBM Tech. Disc. Bulletin" vol. 14, No. 10, Mar. 1972. pp. 2894–2895, "Automatic On-Chip Threshold Voltage Compensation" by L. Forbes.*

*Primary Examiner*—Gerald Goldberg

*Attorney, Agent, or Firm*—H. Christoffersen; S. Cohen; R. G. Coalter

[57] ABSTRACT

An enhancement mode field effect transistor having a threshold voltage, $V_{th}$, is coupled at the source, gate and drain thereof, respectively, to the collector, emitter and base of a bipolar transistor having a nominal forward biased base emitter voltage, $V_{be}$, satisfying the inequality $V_{th} > V_{be}$. Current, applied to the collector and emitter terminals causes a regulated voltage to be produced thereacross which is dependent on $V_{th}$ and independent of $V_{be}$.

9 Claims, 4 Drawing Figures

VOLTAGE REGULATOR CIRCUIT WITH FET AND BIPOLAR TRANSISTORS

This invention relates to regulator circuits and particularly to voltage regulator circuits.

One form of prior art regulator comprises a resistor and a junction diode connected in series across a source of operating voltage thereby providing three possible modes of regulation. For example, the diode may be poled with respect to the applied voltage to conduct current in the forward direction thereby providing an output voltage of typically a fraction of a volt across the diode. The regulation of such a forward biased diode is relatively poor, however, depending not only on temperature but also being proportional to the logarithm of the diode current. The two other operating modes are achieved by reversing the applied voltage so the diode operates in the reverse breakdown region of its characteristic curves. Depending upon the construction of the diode, its reverse breakdown voltage and so forth, operation in the Zener mode or the avalanche mode, or both may result. When operating in the Zener mode, the diode breakdown occurs rather gradually resulting in poor regulation. Very sharp breakdown occurs in the avalanche mode but is accompanied by relatively high electrical noise. The noise, which is predominantly the result of the formation of small high current density discharges within the junction known as microplasma, is characterized by erratic fast rise time current pulses of a uniform amplitude that is substantially independent of the breakdown voltage.

It is known that many of the shortcomings of junction diode regulator or reference circuits may be overcome by the conventional circuit techniques of cascading for improving regulation, and filtering for removing noise. A more direct approach is to replace the breakdown junction diode with a forward biased "diode connected" field effect transistor. By "diode connected" it is meant that the gate and drain are connected together. That approach overcomes the aforementioned noise problem but heretofore has suffered the disadvantage of a relatively high dynamic output resistance due to the relatively low transconductance which is characteristic of field effect transistors generally. While it is known that the transconductors of a field effect transistor may be increased by increasing the channel width-to-length (W/L) ratio, that approach is costly in terms of semiconductor chip area.

The present invention is directly to a voltage regulator circuit which employs at least one field effect transistor for controlling the output voltage and which includes a bipolar transistor for multiplying the dynamic output conductance for improving both source and load regulation. The output voltage is made independent of the forward biased base emitter junction voltage of the bipolar transistor by selection of parameters of the transistors such that an inequality defining operation in the saturation region of the drain characteristics of the field effect transistor is satisfied.

Figure 1:
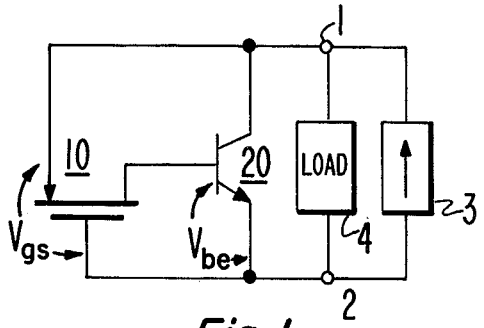
FIG. 1 is a circuit diagram of a voltage regulator circuit embodying the invention.

In FIG. 1 transistor 10 is a P-channel enhancement mode field effect transistor (FET) and transistor 20 is an NPN bipolar transistor. A first output terminal 1 is connected to the source and collector of transistor 10 and 20, respectively, and a second output terminal 2 is connected to the gate and emitter of transistor 10 and 20, respectively. The drain of transistor 10 is connected to the base of transistor 20 and a source of current 3 and a load 4 are connected across the output terminals 1 and 2.

The source of current may be, for example, a voltage source in series with an impedance or it may be of more complex design for providing relatively constant current. It is not necessary that the current be constant, however, since the regulator circuit provides regulation for variations in the characteristics of both the source 3 and the load 4. Load 4 may be any suitable utilization device and need not provide a direct current conductive path between output terminals 1 and 2.

Parameters of transistors 10 and 20 must be selected to assure that FET 10 operates in the saturation region and not the triode region of its drain characteristic curves. The significance of this requirement and how it may be fulfilled is most easily understood by considering, briefly, the difference in the characteristics of an FET in the triode and saturation regions.

When a constant gate-to-source voltage, $V_{gs}$ greater than the threshold voltage, $V_{th}$ is applied to an FET, the drain current will increase linearly at first as the drain-to-source voltage Vds increases from zero. This linear region is termed the "triode" region because of its similarity to the characteristics of a triode vacuum tube. In this condition the FET may be viewed as a "voltage dependent resistor" since the slope of the drain current vs. drain voltage curve is determined by the gate voltage. Significantly, the drain-to-source conductance, *gds*, in this region is relatively high and the transconductance, *gm*, is relatively low.

A transition occurs, however, in which those relationhips reverse as the drain voltage further increases until eventually the FET enters the saturation region characterized by a very low *gds* and relatively high *gm*. In that region the FET behaves as a "current source", that is, its drain current is no longer dependent upon its drain to source voltage. Operation of FET 10 in the saturation region is obtained by satisfaction of the inequality:

$$V_{ds} > V_{gs} - V_{th} \quad (1)$$

Inequality 1 may be satisified in accordance with the invention by selecting the threshold voltage, $V_{th}$ of FET 10 and the nominal value of the forward biased base emitter voltage drop. $V_{be}$, of transistor 20 to satisfy the following inequality:

$$V_{th} > V_{be} \quad (2)$$

With this background, the significance of inequality 2 on the overall circuit operation of FIG. 1 will now be explained by two examples, one in which it is assumed to be satisifed, the other in which $V_{be} > V_{th}$.

Assume that inequality 2 is satisfied and that current source 3 has been off for a period of time so that the output voltage across output terminals 1 and 2 is zero. Load 4, as previously mentioned, might be a direct current blocking element such as a capacitor but for purposes of this discussion will be assumed to comprise a direct current conductive element such as a resistor. When current source 3 is turned on, the output voltage will begin to increase. Since FET 10 is an enhancement mode device, however, no current will flow through the source-drain path thereof to the base of transistor 20 until the output voltage reaches $V_{th}$. Transistors 10 and 20, therefore, initially remain nonconductive providing no regulating action. Also, in this initial turn-on condition, $V_{be}$ of transistor 20 will initially be zero.

When the output voltages reach $V_{th}$, several events occur. First, the source-drain channel of FET 10 becomes conductive thereby supplying a current, $I_b$, to the base of transistor 20. This current, which is related to the transconductance of FET 10, is multiplied by the forward transfer current gain, common emitter configuration, of transistor 20 (hereafter $h_{fe}$ or beta), that is, $I_b h_{fe20}$ flows as collector current through transistor 20. Since, as assumed, $V_{be}$ is less than $V_{th}$, inequality 1 is satisfied so that FET 10 operates in the saturation region where its transconductance is relatively high and where its drain current is independent of the base emitter voltage, $V_{be}$, of transistor 20.

Inequality 1 is satisfied because the collector-to-emitter voltage, $V_{ce}$ of transistor 20 is equal to the sum of the drain-to-source voltage, $V_{ds}$, of FET 10 and $V_{be}$. Since $V_{gs}$ equals $V_{ce}$, $V_{ds}$ therefore equals $V_{gs}-V_{be}$ and since $V_{th}$ has been selected to the greater than $V_{be}$ it follows that $V_{ds} > V_{gs} - V_{th}$ which is the condition for saturation. Thus, in effect the transconductance of FET 10 is multiplied by the current gain of transistor 20 so that transistor 20 provides a current path between terminals 1 and 2 of high conductance thereby preventing further increase in the output voltage. The conductance thereafter changes in response to supply and load variations in a sense to maintain the output voltage constant. FET 10, in other words, provides a degenerative feedback path between the collector and base of transistor 20 which regulates the output voltage ($V_{gs}$ in this example) at a value slightly greater than $V_{th}$. The dynamic output conductance is not simply the transconductance of FET 10 but is approximately beta plus one times as large.

Importantly, it will be noted that the output voltage is not, under the given assumption, influenced by variations in $V_{be}$ since FET 10 is in saturation (the drain current of an FET in saturation, as previously explained, is substantially independent of its drain-to-source voltage). A different situation obtains, however, if inequality 2 is not satisifed. In that case FET 10 is forced to operate in the triode region where gds is relatively high and gm is relatively low. The effect of this on the regulator of FIG. 1, as will now be explained, is that the output voltage will no longer be dependent on $V_{th}$ of FET 10 but instead will be determined by $V_{be}$ of transistor 20.

Assume, for example, that inequality 2 is not satisfied, that is, that the nominal value of $V_{be}$ of transistor 20 is greater than $V_{th}$ of FET 10. When current source 3 is turned on the output voltage will increase from zero eventually exceeding $V_{th}$. When that happens FET 10 will turn on in the saturation mode supplying, initially, a relatively small current to the base of transistor 20. That causes the voltage drop $V_{be}$ to be developed across the base emitter junction of transistor 10 which increases as the logarithm of the base current. Eventually $V_{be}$ will equal $V_{th}$ which, in this circuit, defines the boundary between the triode and saturation regions of FET 10. When $V_{be}$ nears its nominal value (a few hundred millivolts for a silicon transistor) which is greater than $V_{th}$, FET 10 is forced into the triode region.

When that happens *gds* (which ideally is zero in the saturation region) increases to a large value. The effect of this is practically the same as directly connecting the base of transistor 20 to its collector, i.e., transistor 20 thereafter regulates its collector-emitter voltage to its nominal $V_{be}$ value. The output voltage in this case is thus independent of $V_{th}$ of FET 10 and dependent on $V_{be}$ of transistor 20. The circuit 10, 20, in other words, operates in substantially the same way as a forward biased semiconductor junction — a diode, similar to the prior art regulator discussed in the introductory portion of this application. This undesirable situation is avoided, as previously explained, by selecting parameters FET 10 and transistor 20 to satisfy inequality 2.

Figure 2:
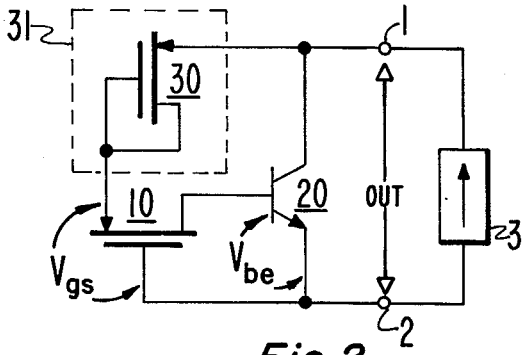
FIGS. 2 and 3 are circuit diagrams illustrating modifications of the circuit of FIG. 1.

In the modified regulator of FIG. 2 the source of FET 10 is coupled to output terminal 1 (and the collector of transistor 20) by means of a threshold conduction device 31 rather than by a direct connection as shown in FIG. 1. The threshold conduction device comprises FET 30 connected as a "diode" and poled to conduct current in the same sense as FET 10. Specifically, FET 30 is connected at the source thereof to terminal 1 and at the gate and drain thereof to the source of FET 10.

The purpose of this modification is to provide a regulated output voltage equal to the sum of the gate-to-source voltages of FETs 10 and 30 which, due to the transconductance multiplication provided by transistor 20 is mainly determined by the sum of the threshold voltages of FETs 10 and 30 and which is independent of $V_{be}$. Transistor 20, as before, increases the dynamic output conductance of the regulator. Still higher output voltages may be obtained by connecting additional "diode connected" FETs in series with FET 30. For the purpose of the following explanation of circuit operation, however, it is sufficient for an understanding of the invention to consider the effect of but one additional transistor, FET 30.

Although the same requirement concerning $V_{th}$ of FET 10 and $V_{be}$ must be met in FIG. 2 as in FIG. 1 (i.e., inequality 2) there is no requirement whatsoever regarding $V_{th}$ of FET 30. The reason for this is that unlike FET 10, the gate to source voltage of FET 30 can never differ from its drain to source voltage. Accordingly, insofar as FET 30 is concerned, inequality 1 is always satisifed so that FET 30 can never operate in the triode region.

Operation, assuming that inequality 2 is satisfied, is much the same as that previously described for FIG. 1 except that regulation does not take place until the output voltage reaches the sum of the threshold voltages of FETs 10 and 30. At that time both transistors turn on supplying current to the base of transistor 20 which in turn conducts current between terminals 1 and 2 thereby preventing further increase in the output voltage. As before, the dynamic output conductance is very low due to the current gain of transistor 20 and the output voltage is independent of $V_{be}$ of transistor 20. Conversely, should inequality 2 not be satisfied, the output voltage will include components due to $V_{th}$ of FET 30 and $V_{be}$ of transistor 20 but will be independent of $V_{th}$ of FET 10.

Figure 3:
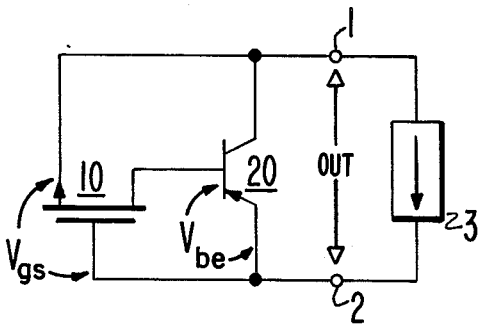

Examples of the invention thus far described have employed one or more P-channel enhancement-mode field effect transistors in combination with an NPN bipolar transistor. As illustrated in FIG. 3, the invention may also be implemented with N-channel FET and PNP bipolar transistors by reversing the polarity of current source 3. This reverses the relative polarity across terminals 1 and 2. Operation is otherwise the same as that previously described.

Figure 4:
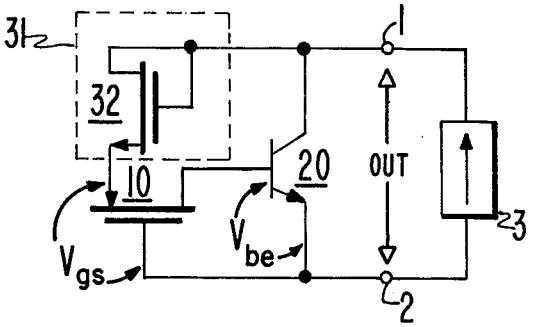
FIG. 4 is a circuit diagram illustrating a modification of the circuit of FIG. 2.

The "diode-connected" field effect transistor coupling the source of FET 10 to the first terminal need not be of the same channel conductivity type as FET 10. This is illustrated in FIG. 4 where P-channel FET 30 has been replaced by N-channel FET 32. FET 32 is connected at the gate and drain thereof to terminal 1 and at the source thereof to the source of FET 10. As in the previous example of FIG. 2, FET 32 is poled with respect to the first terminal to be forward biased. Operation, accordingly, is the same as that previously described.

What is claimed is:

1. A circuit for regulating the voltage across two terminals between which an operating current flows comprising, in combination:

a bipolar transistor having base, emitter and collector electrodes, a path between said emitter and collector electrodes, a junction between said base and emitter electrodes and a nominal base-emitter voltage, $V_{be}$, said emitter-to-collector path being connected between said terminals; and a field effect transistor having source, drain and gate electrodes, a path between said source and drain electrodes and a threshold voltage, $V_{th}$, said threshold voltage and said base-emitter voltage being selected to satisfy the inequality $V_{th} > V_{be}$, said source-to-drain path being connected between the base and collector electrodes of said bipolar transistor in a sense to permit a flow of current in the forward direction through said base-emitter junction, and said gate electrode being connected to said emitter electrode.

2. The combination recited in claim 1 wherein said field effect transistor is an enhancement mode field effect transistor, wherein said drain electrode is directly connected to said base electrode and wherein said source electrode is directly connected to said collector electrode.

3. The combination recited in claim 2 wherein said enhancement mode field effect transistor is a P-channel enhancement mode field effect transistor and wherein said bipolar transistor is an NPN bipolar transistor.

4. The combination recited in claim 2 wherein said enhancement mode field effect transistor is an N-channel enhancement mode field effect transistor and wherein said bipolar transistor is a PNP bipolar transistor.

5. The combination recited in claim 1 wherein said field effect transistor is an enhancement mode field effect transistor and further comprising threshold conduction means connected in series with said source-to-drain path, said threshold conduction means being poled in said sense to permit said flow of current in the forward direction through said base-emitter junction.

6. The combination recited in claim 5 wherein said drain electrode is directly connected to said base electrode and wherein said threshold conduction means is connected between said source electrode and said collector electrode.

7. The combination recited in claim 5 wherein said drain electrode is directly connected to said base electrode and wherein said threshold conduction means comprises a diode connected field effect transistor coupled between said source electrode and said collector electrode.

8. The combination recited in claim 5 wherein said bipolar transistor is an NPN bipolar transistor, wherein said enhancement mode field effect transistor is a first P-channel enhancement mode field effect transistor having the drain electrode thereof directly connected to said base electrode and wherein said threshold conduction means comprises a diode-connected P-channel enhancement mode field effect transistor connected at the source electrode thereof to said collector electrode and at the gate and drain electrodes thereof to the source electrode of said first field effect transistor.

9. The combination recited in claim 5 wherein said bipolar transistor is an NPN bipolar transistor, wherein said enhancement mode field effect transistor is a P-channel enhancement mode field effect transistor having the drain electrode thereof directly connected to said base electrode and wherein said threshold connection means comprises a diode-connected N-channel enhancement mode field effect transistor connected at the gate and drain electrodes thereof to said collector electrode and at the source electrode thereof to the source electrode of said P-channel field effect transistor.

* * * * *